US006179261B1

(12) United States Patent
Lin

(10) Patent No.: US 6,179,261 B1
(45) Date of Patent: Jan. 30, 2001

(54) ADJUSTABLE KEYBOARD SHELF

(76) Inventor: Chin-Chih Lin, 2F, No. 160, Shih Ta Road, Taipei (TW)

( * ) Notice: Under 35 U.S.C. 154(b), the term of this patent shall be extended for 0 days.

(21) Appl. No.: 09/343,190

(22) Filed: Jun. 30, 1999

(51) Int. Cl.[7] ..... E04G 3/00; B68G 5/00
(52) U.S. Cl. ..... 248/274.1; 248/118; 248/918
(58) Field of Search ..... 248/274.1, 118, 248/298.1, 682, 681; 108/42, 134, 147.11

(56) References Cited

U.S. PATENT DOCUMENTS

| | | | | |
|---|---|---|---|---|
| 5,582,375 | * | 12/1996 | Martin | 248/118.3 |
| 5,697,303 | * | 12/1997 | Allan | 248/918 |
| 5,791,263 | * | 8/1998 | Watt et al. | 248/918 |
| 5,823,487 | * | 10/1998 | Kirchoff et al. | 248/118 |
| 6,024,334 | * | 2/2000 | Huang et al. | 248/298.1 |
| 6,079,680 | * | 6/2000 | Kochanski et al. | 248/918 |

* cited by examiner

*Primary Examiner*—Anita M. King
*Assistant Examiner*—Jerome DeLuca
(74) *Attorney, Agent, or Firm*—Dougherty & Troxell

(57) ABSTRACT

An improved adjustable keyboard shelf includes a tray assembly and a palm rest assembly. The tray assembly includes a support plate having a top face provided with a planar portion adapted for placement of a computer keyboard. The support plate has a front side connected to a frame that is internally provided with a longitudinally oriented through frame groove. The palm rest assembly includes a support frame of a size larger than or equivalent to the length of the keyboard for resting of the user's palms. The support frame is provided with two clamping faces that bend downwardly and that correspond to both ends of the frame, respectively. The clamping faces each have an axial hole and a curved slot. The palm rest assembly further includes an adjusting device that has a frame rod passing through the curved slots and the frame groove therebetween. One end of the frame rod is secured on an outer side of one of the curved slots, with the other end lockably coupled with a knob. Two pivot elements are respectively inserted and locked into the axial holes and extending into the frame groove. The knob is loosened to enable the pivot elements and the clamping faces to longitudinally displace in the frame groove so as to allow height adjustment. The curved slots of the clamping faces are capable of displacement along the frame rod to allow elevational angle adjustment. The knob is tightened after operating height and/or elevational angle has been adjusted to meet the user's needs.

13 Claims, 5 Drawing Sheets

ADJUSTABLE KEYBOARD SHELF

BACKGROUND OF THE INVENTION (a) Field of the Invention

The present invention relates to an improved adjustable keyboard shelf, more particularly to an adjustable keyboard shelf that is provided with an ergonomically designed palm rest assembly to allow for height and/or elevation adjustment and that can hold a computer keyboard firmly in position and prevent keyboard from moving during operation.

(b) Description of the Prior Art

Computer keyboards are basic peripherals of computers for input purposes. Although there are other input devices like mouse, track balls, and digital boards, undeniably, keyboards are the most important input tool. Therefore, conventional computer tables are mostly equipped with a retractable adjustable keyboard shelf on which a keyboard can be placed. For those who have to use keyboards for a long period of time every day, they may have sore wrists. Prolonged use may also cause injury to the wrists. Therefore, a kind of multi-media keyboard has been developed in recent years to include a palm rest. However, as keyboards with palm rests are usually bulky, not closable, and relatively costly, standard keyboards are more popular among users. Besides, existing keyboard shelves are now generally provided with a palm rest for use with standard keyboards.

U.S. Pat. No. 5,547,154 discloses a wrist rest assembly that projects from a front end of a rectangular tray. The wrist rest assembly is disposed on a base assembly and connected to a detachable elongate pad. The pad includes a layer of gel coated with a covering layer. A keyboard is placed on the tray to abut against a vertical wall at a rear end of the wrist rest means. In use, the pad is rotatable about 180 degrees and then connected to the base assembly to allow operation at two different heights so as to adapt to the requirements of different users.

However, the wrist rest assembly in said U.S. patent can only allow two-stage height adjustment and does not allow for adjustment of its angle of elevation. It cannot, therefore, be adapted for different types of keyboards. In addition, conventional adjustable keyboard shelves do not have other functions than placement of the keyboard. Therefore, a keyboard placed on a keyboard shelf may easily move.

SUMMARY OF THE INVENTION

A primary object of the present invention is to provide an improved adjustable keyboard shelf to eliminate the drawbacks of the prior art.

BRIEF DESCRIPTION OF THE DRAWINGS

The foregoing and other features and advantages of the present invention will be more clearly understood from the following detailed description the accompanying drawings, in which.

DETAILED DESCRIPTION OF THE PREFERRED EMBODIMENT

Figure 1:
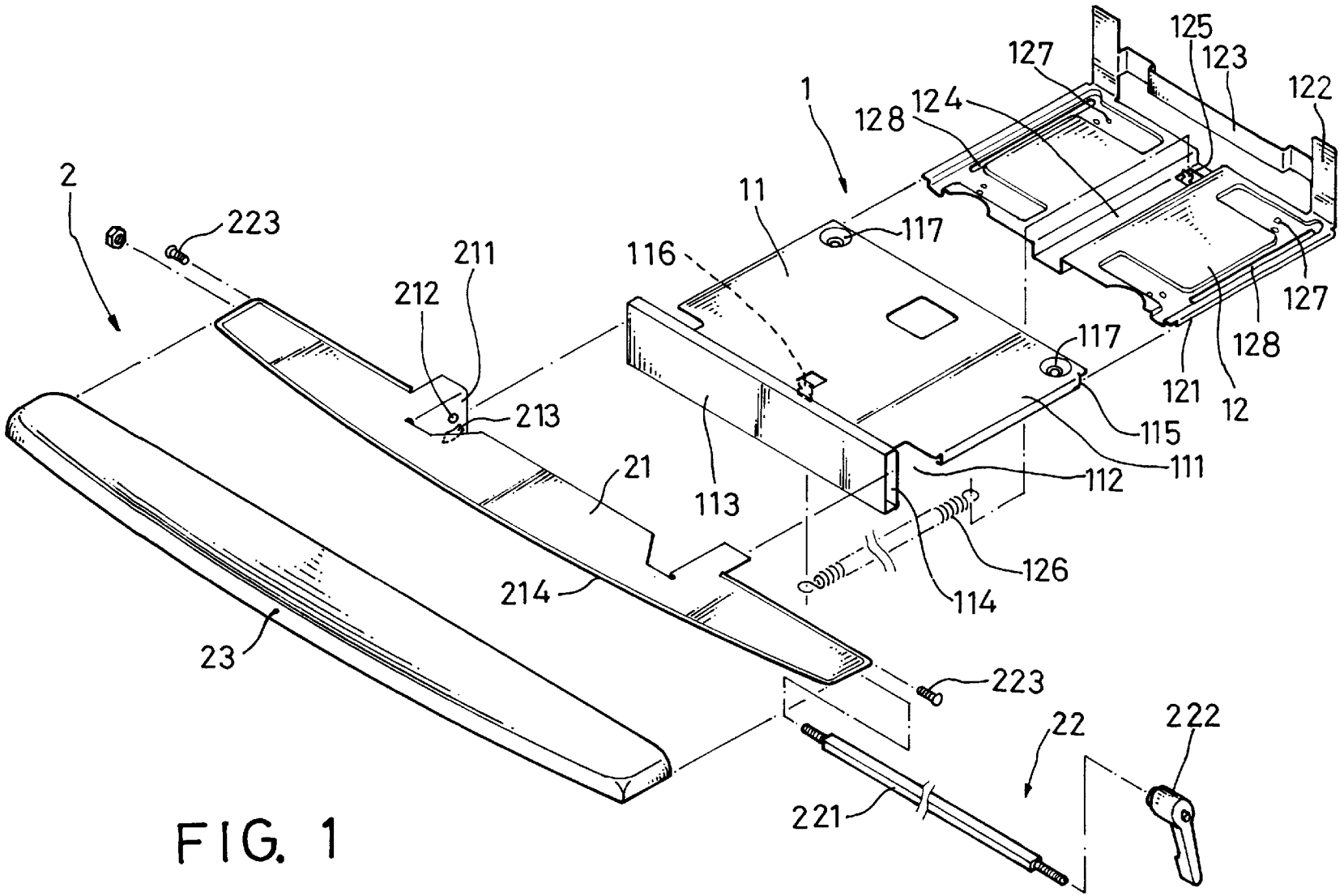
FIG. 1 is an exploded perspective view of a preferred embodiment of an adjustable keyboard shelf of the present invention.
Figure 2:
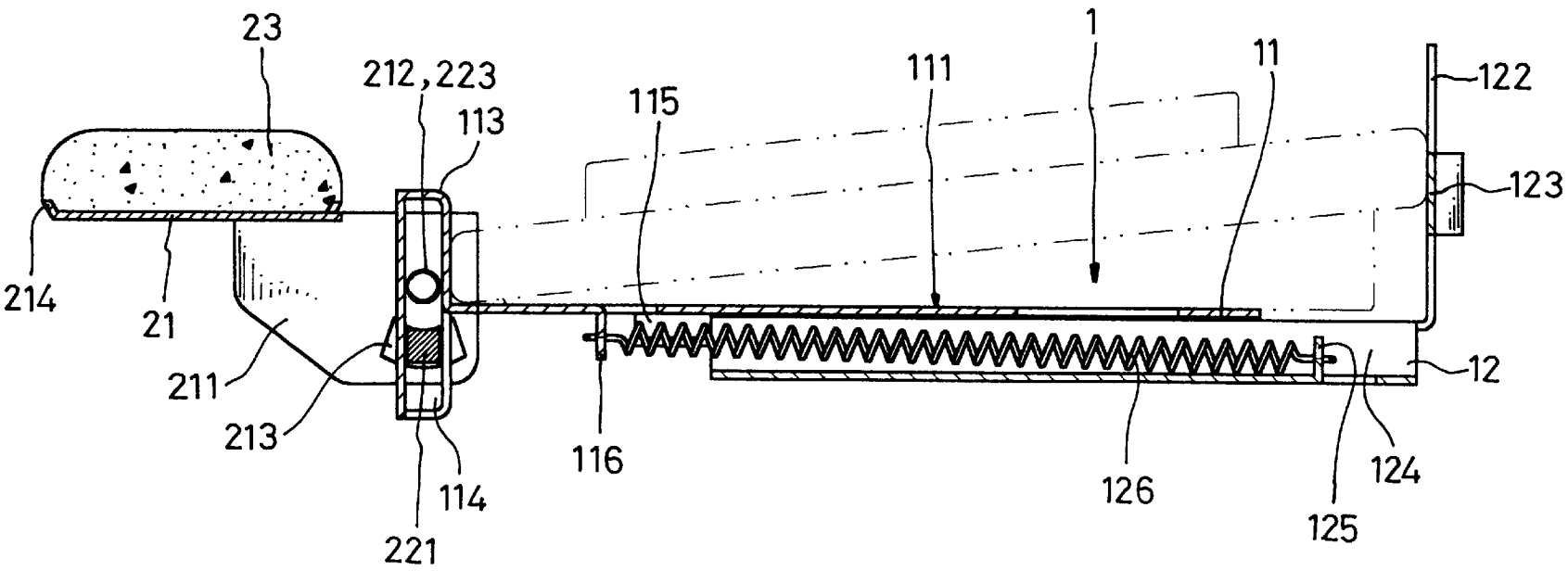
FIG. 2 is an assembled sectional view of the preferred embodiment.
Figure 3:
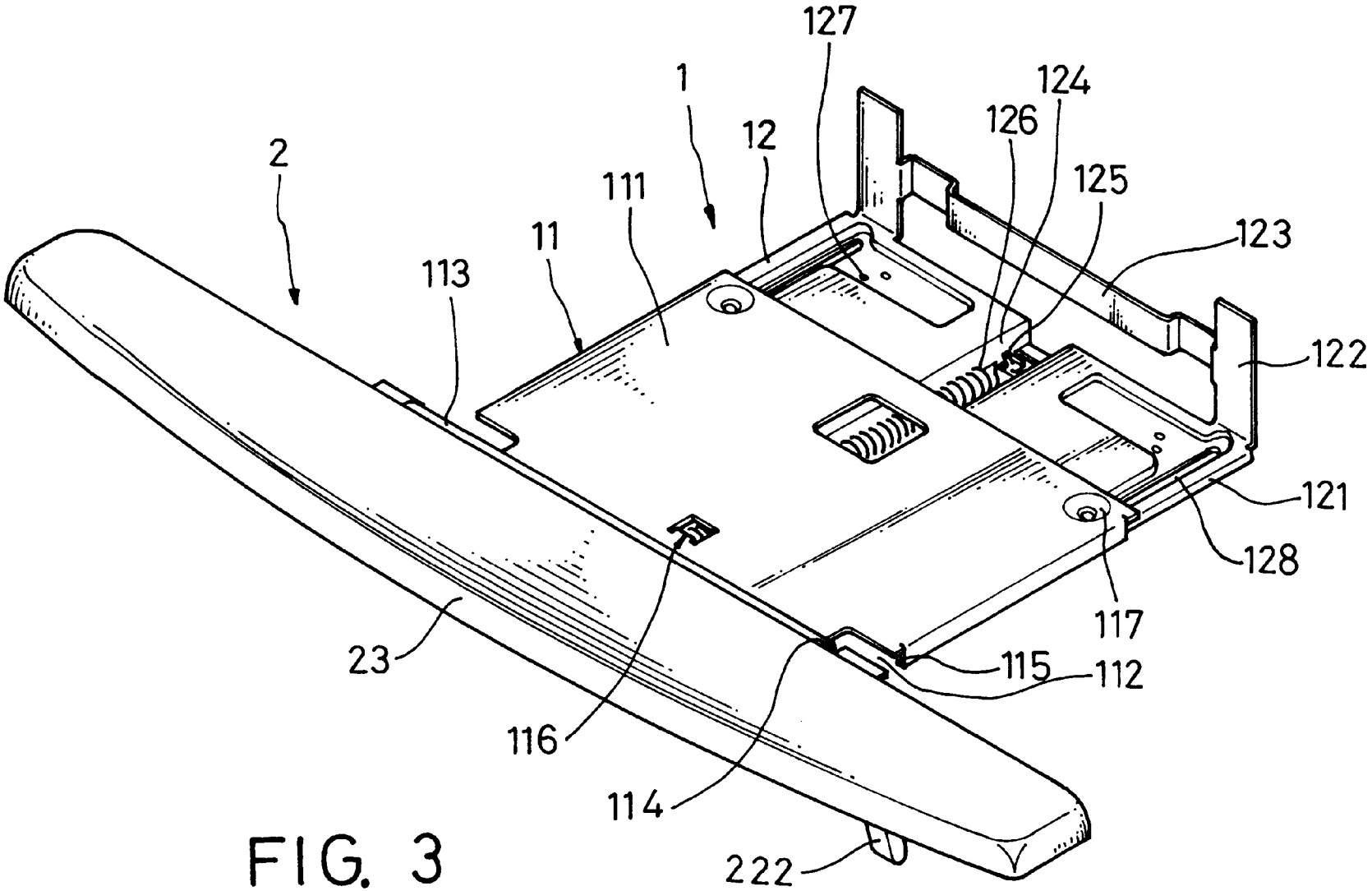
FIG. 3 is assembled perspective view of the preferred embodiment.

With reference to FIGS. 1 to 3, the preferred embodiment of an improved adjustable keyboard shelf according to the present invention is shown to include a tray assembly 1 and a palm rest assembly 2. The tray assembly 1 includes a support plate 11 having a top face provided with a planar portion 111 adapted for placement of a computer keyboard. A front side of the support plate 11 is provided with two indentations 112 on both sides and is connected to a frame 113. The frame 113 is internally provided with a longitudinally oriented through frame groove 114 for connection with the palm rest assembly 2.

Both lateral sides of the support plate 11 bend downwardly to form slide tracks 115, respectively. The tray assembly 1 further includes a securing plate 12. Both sides of the securing plate 12 are provided with opposed slide ribs 121 for insertion into the slide tracks 115 of the support plate 11 such that the support plate 11 can slidably displace above the securing plate 12 in a transverse direction. In addition, the securing plate 12 is provided with at least two stops 122 that extend uprightly from a rear end thereof for abutting against a rear end of the keyboard. In order to enhance the strength and transverse connection of the stops 122, a beam 123 is provided between adjacent stops 122. Furthermore, a recess 124 is formed in the securing plate 12 between and parallel to the slide ribs 121. An end hook 125 extends upwardly from arear end of the recess 124. The planar portion 111 near the frame 113 and opposite to the end hook 125 is provided with a frame hook 116 that extends downwardly. A spring 126 is provided to have one end engaging the end hook 125 with the other end engaging the frame hook 116. Furthermore, the securing plate 12 is preformed with a plurality of plate holes 127 adapted for lockable connection with brackets disclosed in the U.S. Pat. Nos. 5,839,373 and 5,881,984 to the applicant. When it is desired to place the keyboard on the tray assembly 1, since the securing plate 12 is fixedly provided on the adjustable keyboard shelf, the user only needs to pull the frame 113 forwardly so that the spring 126 is stretched. When the distance between the frame 113 and the stops 122 is greater than the width of the keyboard, the keyboard can be placed on the planar portion 111. Then, the frame 113 can be released to allow the spring 126 to retract so that the frame 113 and the stops 122 firmly hold the keyboard in position therebetween, and the keyboard is prevented from moving.

If it is not desired to hold the keyboard in position by means of the elasticity of the spring 126 connecting the support plate 11 and the securing plate 12 of the tray assembly 1, another alternative is available. With reference to FIG. 1, the securing plate 12 is provided with plate slots 128 on inner sides of the slide ribs 121, respectively. Corresponding to the plate slots 128, the support plate 11 is provided with holes 117 at a rear end on both sides. Screws pass through the holes 117 and the plate slots 128 to allow adjustment of the distance between the frame 113 and the stops 122 so that, after placement of the keyboard on the support plate 11, the frame 113 can be pushed towards the stops 122 to clamp the keyboard in position. Then, wing nuts can be coupled to the screws to lock the support plate 11 and securing plate 12 in position.

Referring to FIGS. 1 and 2, the palm rest assembly 2 includes a support frame 21 of a size larger than or equivalent to the length of the keyboard for resting of the user's palms. A rear end of the support frame 21 is provided with two clamping faces 211 that bend downwardly and that correspond to both ends of the frame 113, respectively, such that the frame 113 is retained between the clamping faces 211. The clamping faces 211 are each provided with an axial hole 212 and a curved slot 213 corresponding to the frame groove 114 of the frame 113. A front side of the support frame 21 is configured to have a curved edge 214 to provide comfort for the palms rested thereon. The palm rest assembly 2 further includes an adjusting device 22 that includes a frame rod 221 passing through the two curved slots 213 and the frame groove 114 therebetween. One end of the frame rod 221 is secured on an outer side of one of the curved slots 213, with the other end lockably coupled with a knob 222. Two pivot elements 223 are respectively inserted and locked into the axial holes 221 and extend into the frame groove 114.

Figure 4:
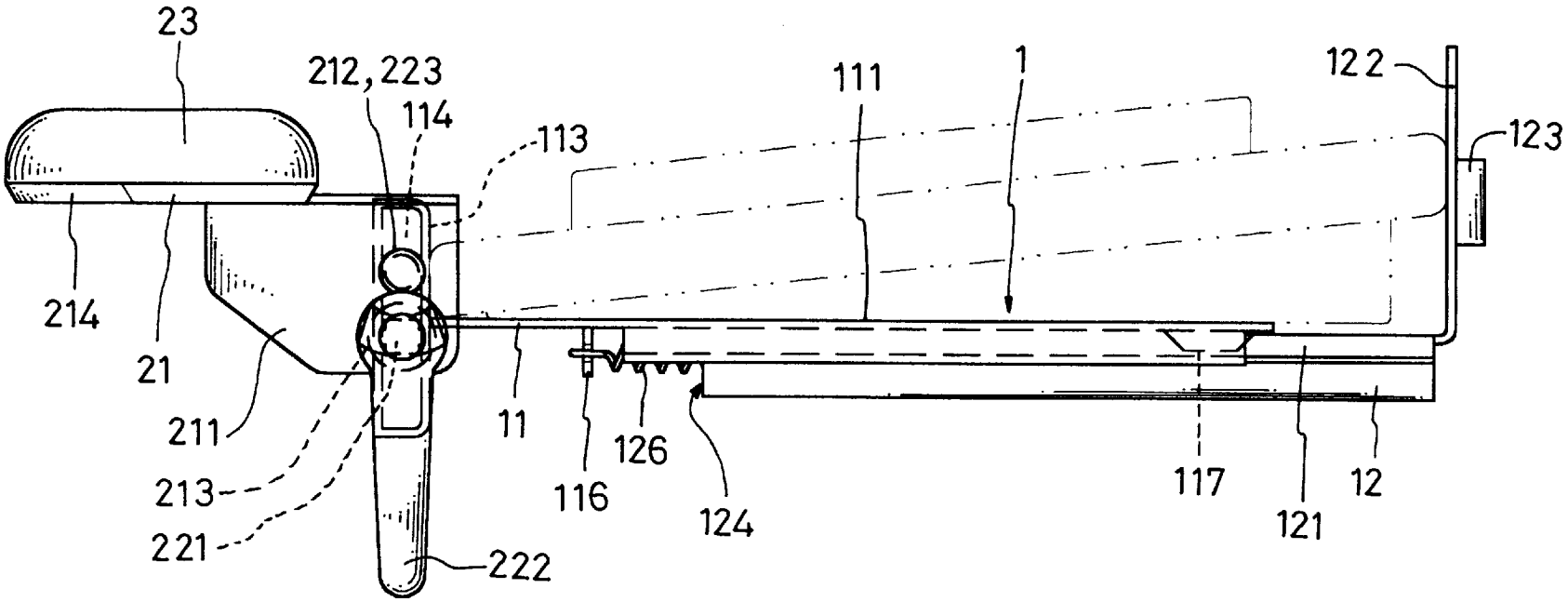
FIG. 4 is a side view of the preferred embodiment prior to adjustment.
Figure 5:
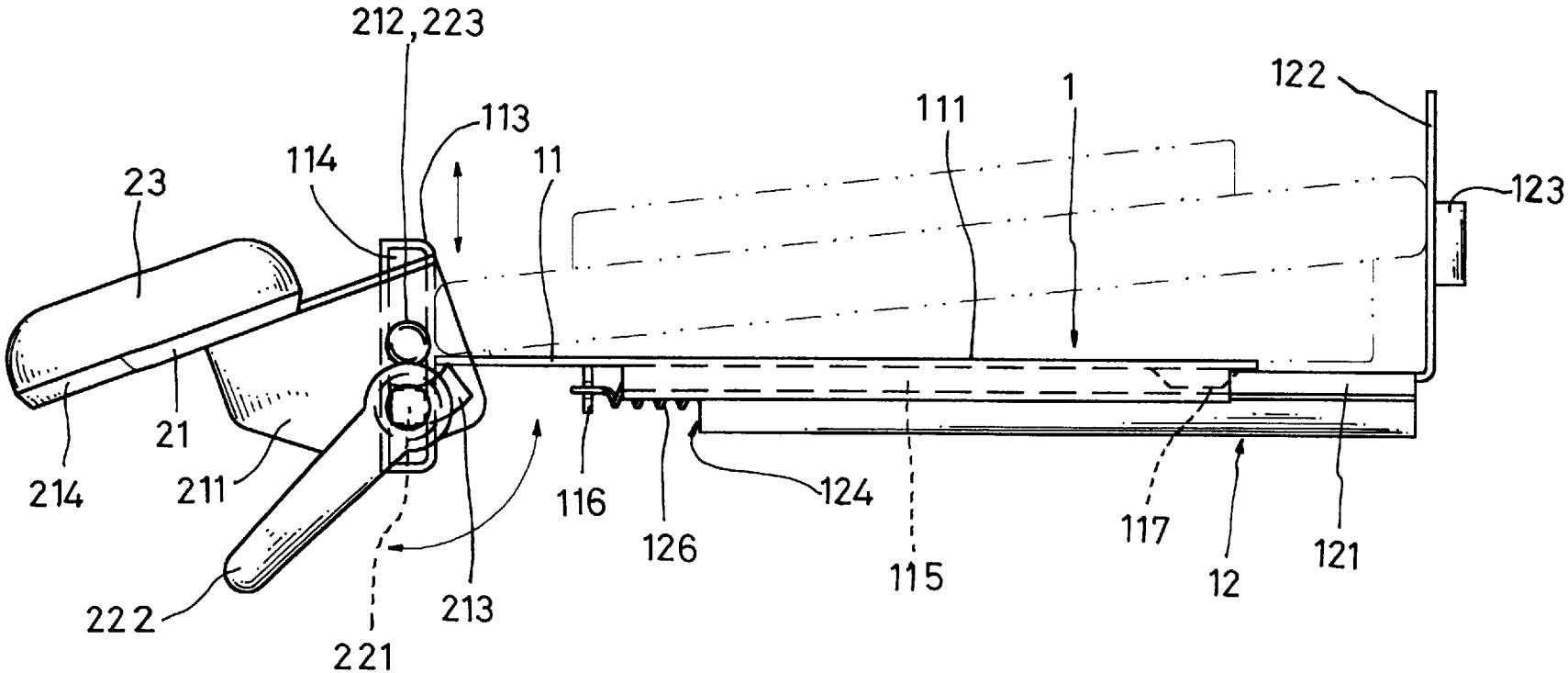
FIG. 5 is a side view of the preferred embodiment after adjustment.

With reference to FIGS. 4 and 5, when it is necessary to adjust the support frame 21, the knob 222 is loosened so that the support frame 21 is released and is capable of slanting towards the curved edge 214. The user may then use the pivot elements 223 as axes to perform longitudinal height adjustment. In addition, by means of the curved slots 213 that displace along the frame rod 221, the angle of elevation of the support frame 21 can be adjusted. When the operating height and/or angle has been duly adjusted, the knob 222 is tightened. Thus, adjustment of the palm rest assembly 2 is accomplished.

Furthermore, in order to enhance the comfort of the palms rested on the support frame 21, the support frame 21 may be connected to a soft pad 23 that is shaped and sized to match therewith.

FIG. 3 shows the adjustable keyboard shelf of the present invention in an assembled state. In the present invention, the relative movement of the support plate 11 to the securing plate 12 enables the keyboard to be secured between the frame 13 and the stops 122 and prevents the keyboard from moving. In addition, the relative displacement of the support plate 11 and the securing plate 12 can be achieved in two different ways depending on the needs of consumers. Furthermore, the palm rest assembly 2 allows for height and/or elevation adjustment. Compared to the prior art, the palm rest assembly of the present invention is more comfortable to use and effectively prevents possible injuries to the user's wrists.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved adjustable keyboard shelf, comprising:

a tray assembly including a support plate having a top face provided with a planar portion adapted for placement of a computer keyboard, said support plate having a front side connected to a frame that is internally provided with a longitudinally oriented through frame groove; and a palm rest assembly including a support frame of a size larger than or equivalent to the length of said keyboard for resting of the user's palms, said support frame being provided with two clamping faces that bend downwardly and that correspond to both ends of said frame, respectively, said clamping faces each being provided with an axial hole and a curved slot, said palm rest assembly further including an adjusting device that has a frame rod passing through said curved slots and said frame groove therebetween, one end of said frame rod being secured on an outer side of one of said curved slots, with the other end lockably coupled with a knob, two pivot elements being respectively inserted and locked into said axial holes and extending into said frame groove;

whereby said knob is loosened to enable said pivot elements and said clamping faces to longitudinally displace in said frame groove so as to allow height adjustment, said curved slots of said clamping faces being capable of displacement along said frame rod to allow elevational angle adjustment, said knob being tightened after operating height and/or elevational angle has been adjusted to meet the user's needs.

2. An improved adjustable keyboard shelf as defined in claim 1, wherein said support frame has a front side provided with a curved edge.

3. An improved adjustable keyboard shelf as defined in claim 1, wherein said support frame has a top side connected to a soft pad of a same size and shape.

4. An improved adjustable keyboard shelf, comprising:

a tray assembly including a support plate having a top face provided with a planar portion adapted for placement of a computer keyboard, said support plate having a front side connected to a frame that is internally provided with a longitudinally oriented through frame groove, both lateral sides of said support plate bending downwardly to form slide tracks, respectively, said tray assembly further including a securing plate, both sides of said securing plate being provided with opposed slide ribs for insertion into said slide tracks of said support plate, said securing plate being provided with two or more stops that extend uprightly from a rear end thereof, a recess being provided between said slide ribs with an end hook extending upwardly from a rear end thereof, said support plate near said frame and opposite to said end hook being provided with a frame hook that extends downwardly, a spring being provided to have one end engaging said end hook with the other end engaging said frame hook; and a palm rest assembly including a support frame of a size larger than or equivalent to the length of said keyboard for resting of the user's palms, said support frame being provided with two clamping faces that bend downwardly and that correspond to both ends of said frame, respectively, said clamping faces each being provided with an axial hole and a curved slot, said palm rest assembly further including an adjusting device that has a frame rod passing through said curved slots and said frame groove therebetween, one end of said frame rod being secured on an outer side of one of said curved slots, with the other end lockably coupled with a knob, two pivot elements being respectively inserted and locked into said axial holes and extending into said frame groove;

whereby said frame is pulled outwardly to stretch said spring until a distance between said frame and said stops is greater than said keyboard, said keyboard being thereafter placed on said planar portion and said frame being released to allow said spring to retract, thereby damping said keyboard firmly between said frame and said stops, said knob being loosened to enable said pivot elements and said clamping faces to longitudinally displace in said frame groove so as to allow height adjustment, said curved slots of said clamping faces being capable of displacement along said frame rod to allow elevational angle adjustment, said knob being tightened after operating height and/or elevational angle has been adjusted to meet the user's needs.

5. An improved adjustable keyboard shelf as defined in claim 4, wherein a beam is transversely disposed between said stops.

6. An improved adjustable keyboard shelf as defined in claim 4, wherein said securing plate is provided with a plurality of plate holes adapted for lockably connection with conventional keyboard brackets.

7. An improved adjustable keyboard shelf as defined in claim 4, wherein said support frame has a front side provided with a curved edge.

8. An improved adjustable keyboard shelf as defined in claim 4, wherein said support frame has a top side connected to a soft pad of a same size and shape.

9. An improved adjustable keyboard shelf, comprising:

a tray assembly including a support plate having a top face provided with a planar portion adapted for placement of a computer keyboard, said support plate having a front side connected to a frame that is internally provided with a longitudinally oriented through frame groove, both lateral sides of said support plate bending downwardly to form slide tracks, respectively, said tray assembly further including a securing plate, both sides of said securing plate being provided with opposed slide ribs for insertion into said slide tracks of said support plate, said securing plate being provided with two or more stops that extend uprightly from a rear end thereof, said securing plate being provided with plate slots on inner sides of said slide ribs, respectively, said support plate being provided with holes at a rear end on both sides to correspond to said plate slots; and a palm rest assembly including a support frame of a size larger than or equivalent to the length of said keyboard for resting of the user's palms, said support frame being provided with two clamping faces that bend downwardly and that correspond to both ends of said frame, respectively, said clamping faces each being provided with an axial hole and a curved slot, said palm rest assembly further including an adjusting device that has a frame rod passing through said curved slots and said frame groove therebetween, one end of said frame rod being secured on an outer side of one of said curved slots, with the other end lockably coupled with a knob, two pivot elements being respectively inserted and locked into said axial holes and extending into said frame groove;

whereby said frame is pulled outwardly until a distance between said frame and said stops is greater than said keyboard, said keyboard being thereafter placed on said planar portion and said frame being pushed inwardly such that said keyboard is clamped firmly between said frame and said stops, screws passing through said holes and said plate slots and being lockably coupled with winged nuts, said knob being loosened to enable said pivot elements and said clamping faces to longitudinally displace in said frame groove so as to allow height adjustment, said curved slots of said clamping faces being capable of displacement along said frame rod to allow elevational angle adjustment, said knob being tightened after operating height and/or elevational angle has been adjusted to meet the user's needs.

10. An improved adjustable keyboard shelf as defined in claim 9, wherein a beam is transversely disposed between said stops.

11. An improved adjustable keyboard shelf as defined in claim 9, wherein said securing plate is provided with a plurality of plate holes adapted for lockably connection with conventional keyboard brackets.

12. An improved adjustable keyboard shelf as defined in claim 9, wherein said support frame has a front side provided with a curved edge.

13. An improved adjustable keyboard shelf as defined in claim 9, wherein said support frame has a top side connected to a soft pad of a same size and shape.

* * * * *